United States Patent [19]

Gibson

[11] 4,211,007

[45] Jul. 8, 1980

[54] CHAIN SAW GUIDE BAR AND SAWDUST PLATE

[76] Inventor: Earl W. Gibson, Rte. 5, Box 69, Lucedale, Miss. 39542

[21] Appl. No.: 12,898

[22] Filed: Feb. 16, 1979

[51] Int. Cl.[2] ..... B27B 17/12

[52] U.S. Cl. ..... 30/383

[58] Field of Search ..... 30/381, 382, 383, 384, 30/385, 386, 387; 184/15 R

[56] References Cited

U.S. PATENT DOCUMENTS

| | | | |
|---|---|---|---|
| 3,636,995 | 1/1972 | Newman | 30/386 |
| 3,777,401 | 12/1973 | Arff et al. | 30/383 |
| 3,829,971 | 8/1974 | Anderson | 30/383 |
| 3,840,991 | 10/1974 | Arff et al. | 30/383 |
| 3,870,125 | 3/1975 | Gorski | 30/383 X |

*Primary Examiner*—Jimmy C. Peters
*Attorney, Agent, or Firm*—Wenderoth, Lind & Ponack

[57] ABSTRACT

An improved guide bar for a chain saw having two sawdust kick-out holes in the rear of the guide bar. Each kick-out hole passes completely through the guide bar and through a guide groove in the bar. Also provided are at least two lubricating holes in the guide bar which extend through the bar and guide groove. The lubricating holes are straight holes transverse to the guide groove with a countersunk portion at the outer edge thereof, and the lubricating holes are designed to communicate with a lubricating means in the chassis of the saw, so that lubricating oil can be supplied into the guide groove. Also provided is a special sawdust plate designed to fit between the bar and the chassis of the saw.

4 Claims, 4 Drawing Figures

CHAIN SAW GUIDE BAR AND SAWDUST PLATE

BACKGROUND OF THE INVENTION

The present invention relates to saw bars for use with a chain saw, and more particularly, the invention relates to an improved saw bar which facilitates oiling of the chain and removal of sawdust which collects in the bar.

A chain saw is provided with a guide bar that is utilized to support the moving cutting chain that performs the cutting action, and generally, there is a groove around the outer edge of this guide bar which contains the cutting chain. When the chain saw is in use, there is a great tendency for this groove to fill with sawdust and, if the groove is left uncleaned, the sawdust will eventually cause the chain to jam in the groove. Therefore, it is necessary to frequently stop cutting in order to clean the accumulated sawdust out of the groove so that the chain can continue to move smoothly and uninterrupted by the sawdust.

While it is recongized that sawdust accumulation in the groove is a serious problem, very few improvements have been provided to eliminate the problem. One improvement, however, is presented in U.S. Pat. No. 3,829,971 to Anderson. In this patent, numerous alternating holes are formed in the guide bar on opposite sides of the guide groove at the end of the bar extending from the motor chassis. These holes allow the sawdust to be "kicked out" of the groove before it has a chance to accumulate. This structure, unfortunately, requires numerous holes to be formed in the portion of the guide bar that receives the greatest external force, and the thus-weakened bar can have a shorter, safe working life span, and of course, the structure required much additional machining to provide all of the holes.

Another frequent problem which plagues the free and uninterrupted use of a power chain saw is the constant plugging of the oil lubricating holes which lubricate the moving chain within the guide groove. Nearly all chain saws, especially those which are used commercially and receive constant use, have these lubricating holes. For the most part, the holes are formed in the guide bar transverse to the guide groove and the holes are communicated with a lubrication supply or supply means in the chassis of the saw which provides a lubricating oil to the chain in the guide groove through these holes. Because of the transverse orientation of these holes, however, they are very susceptible to being filled and eventually clogged with sawdust, and thus, oil is prevented from reaching the chain. The saw must then be stopped and the holes cleaned of sawdust before cutting can continue.

In an effort to overcome these problems, several patents have been obtained on guide bar structures which have altered dramatically the configuration of the lubricating holes: Arff et al., U.S. Pat. Nos. 3,777,401 and 3,840,991, and Gorski, U.S. Pat. No. 3,870,125. While these patents disclose interesting new design features for the lubricating holes, they require intricate machining and, moreover, the designs are not readily adaptable to the numerous guide bars which are already provided with simple straight, transverse lubricating holes.

SUMMARY OF THE INVENTION

In light of the above-presented problems which are prevalent in the standard, and even the mentioned improved, chain saw guide bars, it is a primary objective of this invention to provide a guide bar which effectively, efficiently, and economically overcomes all of these problems.

Principly, the present invention is intended to provide an improved structure which prohibits sawdust from collecting in the guide groove of the guide bar. In addition, the present invention is also intended to provide an improved configuration for the transverse lubricating holes which will prevent the holes from becoming clogged with sawdust. And finally, the present invention is further intended to provide an improved sawdust plate to fit on the side of the guide bar as it is held in the saw chassis.

In this improved guide bar, sawdust kick-out holes are provided in the rear of the guide bar. Each hole passes completely through the bar and through the guide groove in the bar. Also provided is at least one lubricating hole in the guide bar which also extends through the bar and guide groove. The lubricating hole is straight and perpendicular to the guide groove with a countersunk portion at the outer edge thereof, and they are designed to communicate with a lubricating means in the chassis of the saw, so that lubricating oil can be supplied into the guide groove. Also provided is a special sawdust plate designed to fit between the bar and the chassis of the saw.

BRIEF DESCRIPION OF THE DRAWINGS

The above-mentioned and further objectives of the present invention will become more apparent from the following description taken in consideration with the formal drawings wherein.

DETAILED DESCRIPTION OF THE INVENTION

Figure 1:
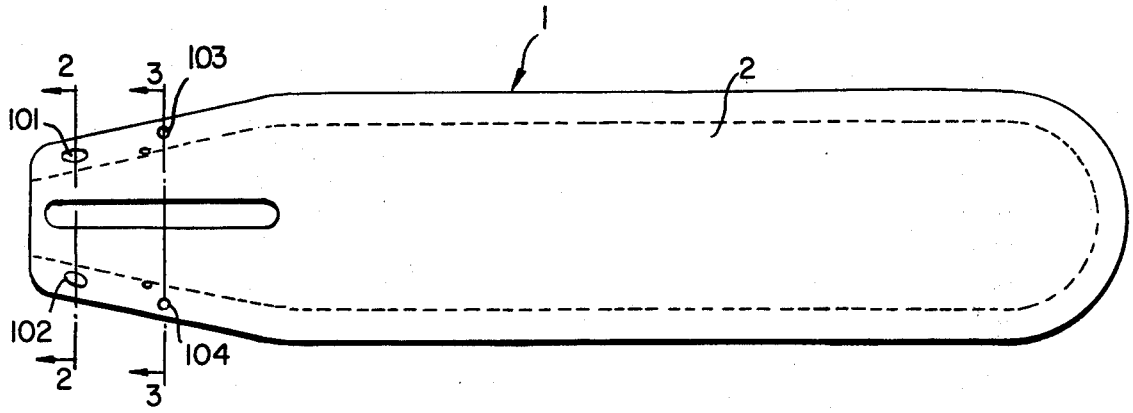
FIG. 1 is a side view of a guide bar of the present invention.

The improved guide bar 1 for a chain saw as shown in FIG. 1 includes two sawdust kick-out holes 101, 102 and at least two lubricating holes 103, 104. In the section views which are presented in FIGS. 2 and 3, a guide groove 2 in the guide bar 1 can be clearly seen. This guide groove 2 surrounds the circumference of the guide bar 1 and the two sidewalls 201, 202 of the groove provide a support for a cutting chain which rests thereon and extends into the groove (not shown).

Figure 2:
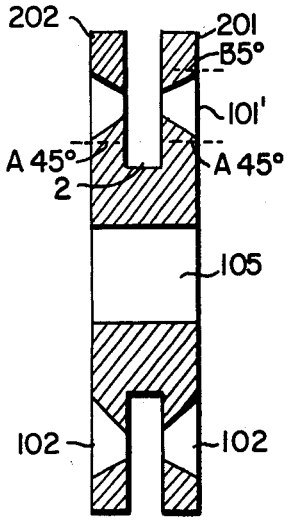
FIG. 2 is a section view of a sawdust kick-out hole in the guide bar taken along line 2—2 in FIG. 1.

It can be further seen in FIG. 2 that the sawdust kick-out holes 101, 102 in the sidewall 201 have corresponding kick-out holes 101', 102' directly opposite them across the groove in sidewall 202. Therefore, in essence, openings are provided in the guide bar 1 which extend all the way through the sidewalls and the guide groove.

While it is recognized that ordinary circular holes simply transverse to the groove 2 might suffice to allow the sawdust to escape from the groove, it is preferred that the kick-out holes be slightly elongated or oval and that the bottom sidewall of the oval or that portion of the oval sidewall near the longitudinal axis of the guide bar extends outward from the guide groove 2 at an angle A of approximately 45°. The upper or outer sidewall near the edge of the guide bar of the oval preferably extends outward from the guide groove 2 at an angle B of approximately b 5°.

Figure 3:
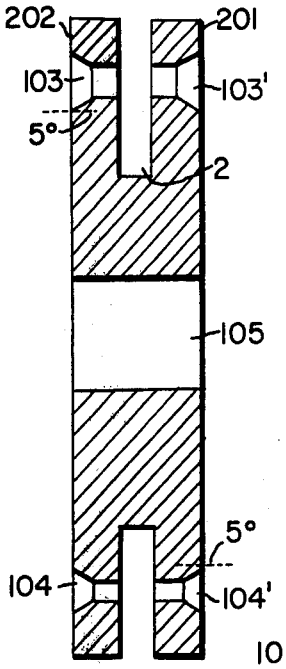
FIG. 3 is a section view of an oil delivery hole in the guide bar taken along line 3—3 in FIG. 1.

Similar to the opposing pairs of sawdust kick-out holes, directly opposite pairs of lubricating holes 103, 103' and 104, 104' are formed in the guide bar 1 through the sidewalls 201, 202 and the guide groove 2 (FIG. 3). The prior art lubricating holes usually are formed transverse to the groove and are straight circular holes. In the present invention, however, as shown in FIG. 3, it has been determined that providing a substantially countersunk angled portion in each hole at the outside of the guide bar will prohibit sawdust from becoming clogged in the hole. Preferably the sidewalls in each countersunk portion are angled approximately 5°, and the holes themselves are perpendicular to the guide groove.

While it is anticipated that present manufacturing processes for producing guide bars can be easily modified to form lubricating holes with a countersunk end portion, it is also quite easy to modify any previously bored lubricating holes in guide bars to provide these countersunk portions by simply redrilling the existing straight oil holes to provide a countersunk portion.

Figure 4:
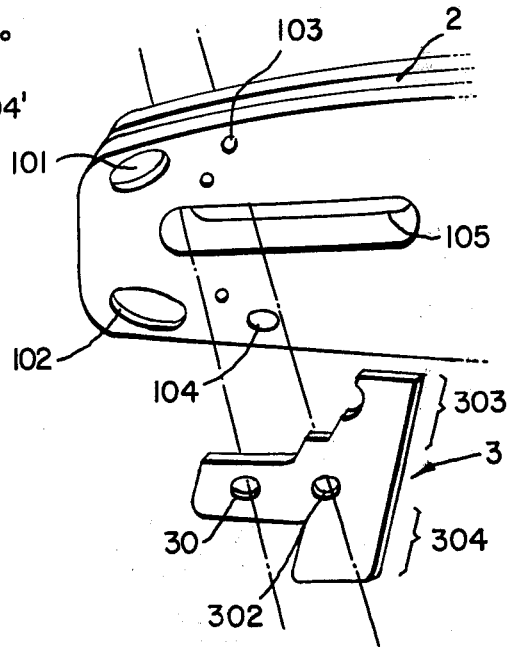
FIG. 4 is a side view of the sawdust plate of the present invention as it is intended to fit against the guide bar.

The new sawdust plate 3 shown in FIG. 4 is especially designed to fit against the guide bar 1 when the bar is in position inside the saw chassis. This plate is preferably made of metal; however, it is foreseeable that some synthetic materials may also be used. The holes 301, 302 are designed to align with an elongated openings 105 through one end of the guide bar 1, and, in this manner, the bar 1 and the plate 3 are mounted together onto bolts in the saw chassis. (These bolts are conventional and are not shown.) The lower portion 304 of the plate extends downward and is especially designed to cover the lower lubricating hole 104. The upper portion 303 of the plate, on the other hand, is specially formed to extend upward along the bar, is designed to leave the upper lubricating hole 103 exposed. The upper lubricating holes in this instance are in communication with the lubricating means, and by providing the plate of the present invention, the sawdust is further prevented from collecting in these lubricating holes. This, in turn, helps to assure that the lubricating of the chain in the groove will continue uninterrupted by sawdust clogging the lubricating holes. Also, by providing this plate, a space between the guide bar and the chassis is created so that the sawdust being eliminated through the kick-out holes 101, 102 is not trapped by the chassis.

The present improvements are also very adaptable to a guide bar which is designed to be reversed in the chassis. (Reversing the cutting edge of the bar helps to prolong the life of the bar by preventing one edge from wearing more than the other.) By providing the sawdust kick-out holes at both the top and the bottom of the guide bar 1, the sawdust removal function is performed equally well when the guide bar is reversed. Reversing of the guide bar is further made possible by providing the bar with both the upper 103 and lower 104 lubricating holes, even through only one set of holes is used for lubricating at any time. The upper holes receive the lubricating medium, but which set of holes is in the upper position is a matter of choice.

When the guide bar 1 is provided with the opposing pairs of sawdust kick-out holes 101, 101', and 102, 102' and the countersunk transverse oil holes 103, 103', and 104, 104' as discussed herein, the amount of sawdust which usually builds up in the groove 2 as the saw is operated is greatly reduced and the oil holes into the groove no longer clog with sawdust which inhibits the flow of oil therethrough.

It is realized that further modifications might be made to the embodiments disclosed herein, and therefore, it is not intended that the scope of the invention be strictly limited to these embodiments.

What is claimed is:

1. In a power chain saw including:

a guide bar having a guide groove therearound for receiving and guiding a cutting chain, said guide groove having sidewalls on both sides thereof, a chassis said chassis having bolts therein to which said guide bar is secured, and lubricating means in said chassis for supplying a lubricant into said guide groove of said guide bar, an improvement comprising:

an improved guide bar having at the rear portion thereof at least one sawdust kick-out hole extending completely through said sidewalls and said guide groove and a plurality of lubricating holes extending perpendicularly through said sidewalls and said guide groove, said lubricating holes being countersunk at the outer ends thereof, and at least one of said lubricating holes being in communication with said lubricating means, whereby lubricant from said lubricating means is delivered into said guide groove through said lubricating holes; and a bar plate adapted to be positioned adjacent said guide bar and attached to said chassis on said bolts connecting said guide bar to said chassis, said bar plate spacing said guide bar from said chassis, and said plate covering said lubricating holes not in communication with said lubricating means.

2. An improvement as claimed in claim 1, wherein said sawdust kick-out holes have an oval shape.

3. An improvement as claimed in claim 2, wherein the sidewalls of said oval holes near the longitudinal axis of said guide bar are angled at 45° towards said guide groove, and the sidewall of said oval near the outer edge of said guide bar is angled at 5° toward said guide groove.

4. An improvement as claimed in claim 1, wherein said countersunk portions of said lubricating holes are angled at 5° from the outer edge of said guide bar.

* * * * *

UNITED STATES PATENT AND TRADEMARK OFFICE

CERTIFICATE OF CORRECTION

PATENT NO. : 4,211,007

DATED : July 8, 1980.

INVENTOR(S) : Earl W. Gibson

It is certified that error appears in the above-identified patent and that said Letters Patent are hereby corrected as shown below:

In column 1 of the Patent, line 16, change "jam" to --run hot--.

Signed and Sealed this

*Fourth* Day of *November 1980*

[SEAL]

*Attest:*

SIDNEY A. DIAMOND

*Attesting Officer*

*Commissioner of Patents and Trademarks*